United States Patent [19]

Rial

[11] Patent Number: 4,887,588

[45] Date of Patent: Dec. 19, 1989

[54] GREASE ABSORPTION BOX FOR ROOF USE

[76] Inventor: Terry Rial, R.R. #1, Box 161, Clare, Iowa 50524

[21] Appl. No.: 291,220

[22] Filed: Dec. 27, 1988

[51] Int. Cl.[4] ..... F24C 15/20

[52] U.S. Cl. ..... 126/299 R; 55/429

[58] Field of Search ..... 55/429, 467, DIG. 36; 52/302, 303; 98/115.1; 126/299 R, 299 D; 272/1 A

[56] References Cited

U.S. PATENT DOCUMENTS

| | | | |
|---|---|---|---|
| 1,431,530 | 10/1922 | Leicester | 52/302 |
| 1,746,816 | 2/1930 | Boes | 52/303 |
| 2,269,656 | 1/1942 | Fowler | 52/302 X |
| 2,874,627 | 2/1959 | Simmonds | 126/299 D |
| 3,837,269 | 9/1974 | Sweet et al. | 126/299 D |
| 4,084,947 | 4/1978 | Ear | 55/242 |
| 4,500,331 | 2/1985 | Cheng | 55/406 |
| 4,578,091 | 3/1986 | Borja | 55/90 |
| 4,635,617 | 1/1987 | Simonsen | 126/299 E |

FOREIGN PATENT DOCUMENTS

| | | | |
|---|---|---|---|
| 2644799 | 4/1978 | Fed. Rep. of Germany | 272/1 A |

*Primary Examiner*—Harold Joyce

*Attorney, Agent, or Firm*—Zarley, McKee, Thomte, Voorhees & Sease

[57] ABSTRACT

A grease absorption curb system for use in conjunction with roof top cooking exhaust fans to prevent grease which accumulates around restaurant exhaust fans from degrading roof top materials. The curb comprises a plurality of durable, lightweight, non-biodegradable blocks which are releasably joined together by a tongue and groove system to define a perimeter curb around the exhaust fan, with at least some of the blocks having drain tubes to allow water to drain from within the perimeter curb system to outside of the curb system.

11 Claims, 2 Drawing Sheets

GREASE ABSORPTION BOX FOR ROOF USE

BACKGROUND OF THE INVENTION

Restaurants and fast-food facilities do much cooking in grease. Typically the deep fat fryers have a hood which exhausts the vaporized grease away from the fryer via an exhaust fan and out to the roof area. However, the grease does deposit on the exhaust fan and also on the roof of the restaurant. Over a period of time this grease gradually builds up and collects about the fan structure, the fan housing, and as well on the roof. If not removed in time, the grease will become highly corrosive to the roofing materials, eventually causing deterioration of shingles and rotting of the underlying boards. Accumulated grease is also known to provide a significant fire hazard, and since it makes the surrounding area highly slippery, also a safety hazard. There is, therefore, a continual need to prevent such grease accumulation so that the attendant problems associated therewith can be eliminated.

In the past, it was known to arrange wooden sandboxes beneath the exhaust fan housing on a restaurant roof. However, this is not very satisfactory in that it requires frequent and troublesome maintenance. Particularly the sandbox itself is susceptible to the same roof rot caused by grease. Other forms of grease collectors have been proposed, including complex systems which use solvent catch basins, see for example U.S. Pat. No. 4,635,617 issued Jan. 13, 1987. The trouble with solvent catch basins is that they are simply not practical. This is true because they are extremely expensive, and in areas where there is subjection to wide ranging temperature variations such as in the Northern parts of this country, there may be a distinct temperature effect, not only the grease but also on the solvent system. Moreover, solvent systems are difficult to install and expensive. Simple put, the cost outweighs the benefits achieved.

There is, therefore, a continuing need for the development of a simple, reusable, and economical sandbox type system, which achieves the economic advantages of a wooden sandbox without the attendant inherent problems in sandbox systems. This invention has as its primary objective the fulfillment of this need.

Yet another objective of the present invention is to develop a perimeter curb system for use in roof top traps for grease, which system is lightweight, durable, noncorrosive with exposed grease, and which allows collected water to weep away so that there is collection of grease only.

A further objective of the present invention is to provide a universally usable perimeter curb system which can be easily modified on site for the variety of differing types of roof top fan exhaust systems.

An even further objective of the invention is to provide a perimeter curb system which is long lasting, durable, and economical.

The method of accomplishing these and other objectives of the present invention will become apparent from the detailed description which follows.

DETAILED DESCRIPTION OF THE INVENTION

Figure 1:
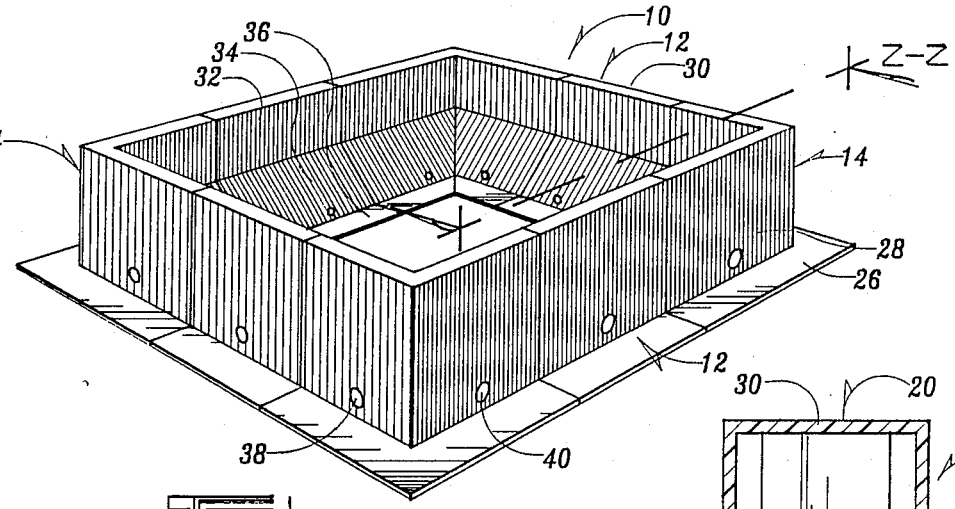
FIG. 1 is a perspective view of the curbed system of this invention.
Figure 2:
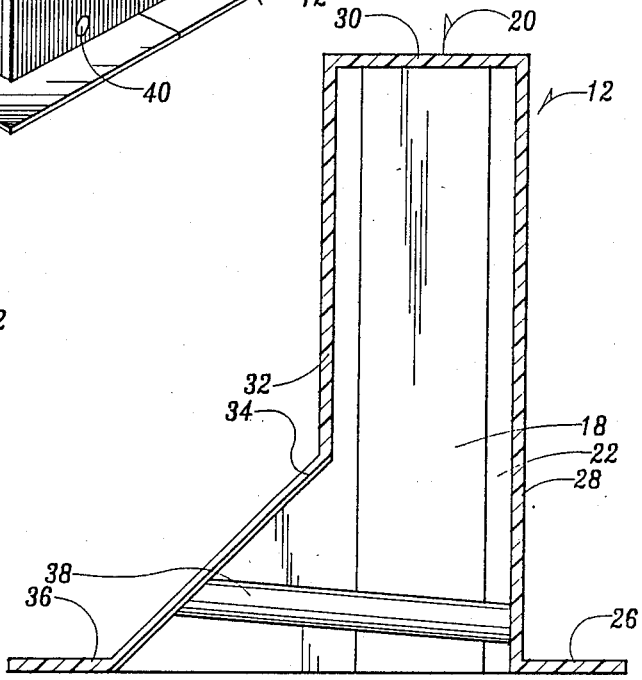
FIG. 2 is a sectional view along line 2–2 of FIG. 1 of one of the blocks.

Looking first at FIGS. 1 and 2, in FIG. 1 particularly there is shown a perspective view of the grease absorption curb system, referred to generally at 10. The curb system 10 is comprised of a plurality of individual blocks, with 12 representing an intermediate or center block and 14 representing a corner block. Each of the blocks has at one end a groove 16 and at the other end a tongue 18. Thus, a series of the blocks may be joined to form the perimeter curb system 10. The size of the perimeter curb can vary, of course, depending upon the number of blocks used. Thus, a curb system can be built to accommodate fans of differing size.

The details of construction of one of the blocks can be seen by looking at FIG. 2 which is a sectional view of side block 12 along line 22 of FIG. 1. It can be seen that side block 12 is a shell 20 which defines a hollow interior portion 22. The shell 20 can be comprised of any durable, lightweight, non-biodegradable, and moldable plastic material. Suitable materials are made of moldable polymeric resins. One especially suitable material is reinforced fiberglass. However, the shell may be made from moldable polymeric resinous materials other than fiberglass and one can use polyvinyl chloride, polyethylene, polypropylene, styrene, and other moldable resinous materials as well. The important point is that the material is non-biodegradable, durable, and lightweight. The term non-biodegradable as used here refers to corrosion resistance to grease. It is to be distinguished from wood which is known to rot after continued exposure to grease. The shape of the shell 20 of block 12 is generally illustrated in FIG. 2. It has a bottom or flattened perimeter edge 26, a vertical exterior wall 28 joined to a top 30, a downwardly extending interior wall 32 joined to an interior shoulder 34 which is at a sloping angle, preferably at 45° to downwardly extending into interior wall 32. Sloping wall 34 joins a flattened perimeter edge 36 which is of like construction to flattened perimeter edge 26. Thus, the block will rest against a horizontal surface on flattened perimeter edges 26 and 36 respectively. This precise configuration of shell 20 is not essential but is highly preferred.

Figure 3:
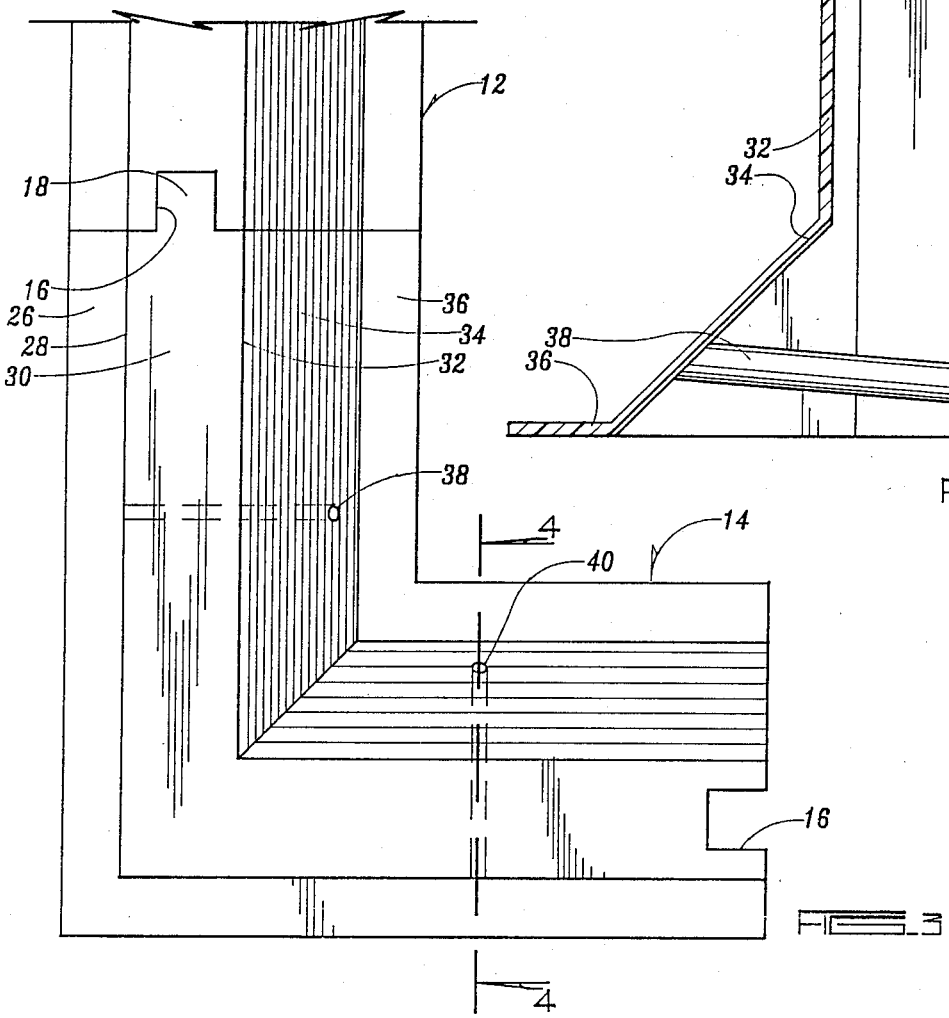
FIG. 3 is a plan view, with parts broken away of a corner block showing the means for water drainage.
Figure 4:
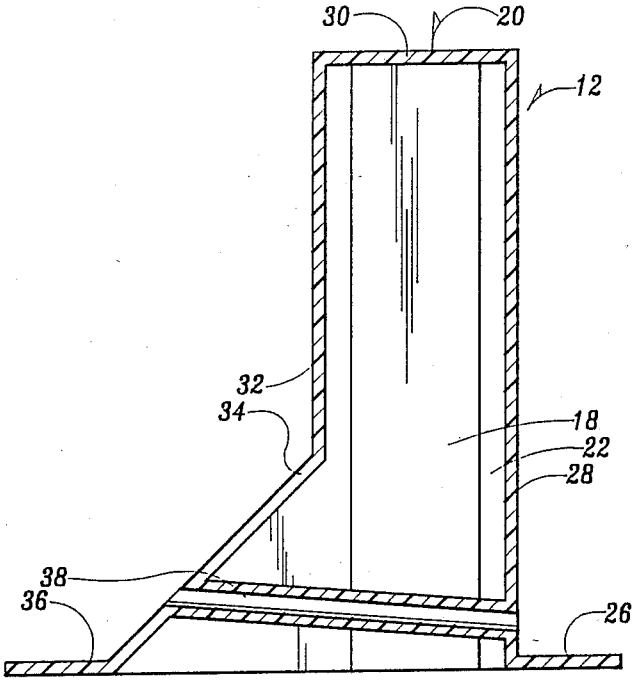
FIG. 4 is a sectional view along line 4–4 for FIG. 3.

FIG. 3 shows a plan view of a corner block 14. It is of similar shape to intermediate or side block 12, except that it has a defined 90° corner. As also illustrated in FIG. 3, corner block 12 has two weep tubes 38 and 40 which allow water that drains downwardly through the material filling the curb system to be drained away from the bottom, through the shell 20 of the blocks, from where it spills on to the roof and is drained away in conventional fashion. In this way the improved sandbox of the present invention does not hold substantial amounts of water which must be manually drained away. Weep or drain tubes 38 and 40 can be separately installed in the blocks or may be integrally molded therewith. One satisfactory way is to simply drill and mount within the blocks a quarter inch inside diameter polyvinyl chloride tube. FIG. 4 illustrates the mounting of the weep tube in detail and is a view taken along line 44 of FIG. 3.

Figure 5:
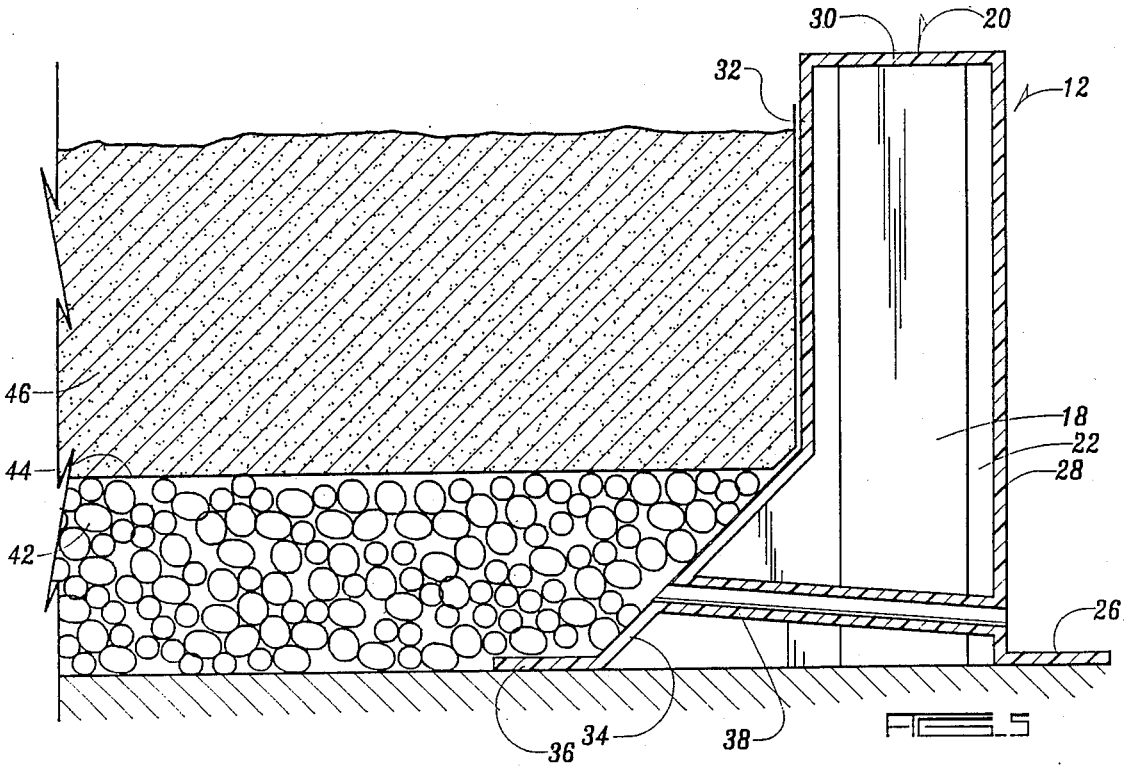
FIG. 5 is an enlarged perspective view with certain parts broken away showing the system filled and ready for use.

FIG. 5 represents an elevated perspective view with parts broken away showing the completely installed perimeter curb system of the present invention. The system 10 is mounted on a roof top to define a perimeter edge around a roof top exhaust fan. In actual installation the individual blocks forming the system are taken to the roof, and put together in tongue and groove fashion around the exhaust fan in order to see how many pieces and in what particular dimension they will be put together. After this rough assembly around the roof fan, the corner locations are marked and the grease absorption curb is then taken apart, a conventional polymeric adhesive is applied to the tongue and groove joints and they are reassembled in the same location. The curb is now cemented together. The bottom of the curb system is filled with pea gravel 42 to a depth of about 2 inches. The pea gravel or pea rock are small rocks having diameters of from about ⅜ inch to about ½ inch ideally. On top of the bottom layer of pea rock 42 is a flexible sheet of material, for example 6 milliliter visqueen 44. The visqueen 44 is perforated so that water may drain therethrough. On top of visqueen layer 44 is about 3 inches of grease absorption material, for example medium grade silica sand 46. Once installed the grease catcher works in the following manner. Grease expelled from the interior of the kitchen in a vaporized fashion goes up through the vent and accumulates on and around the exhaust fan. Eventually it drips down from the fan and is caught in the grease absorption media (silica sand) 46. Water is not accumulated because water that does come off drains through the sand 46, passes through the perforations and visqueen sheet 44, down into the pea gravel 42. It drains through the pea gravel 42 and out through the weep tubes 38 from where it can drain away off of the roof in conventional fashion. Periodically as the amount of grease that accumulates in the sand 46 is such that it becomes nearly saturated, the sand is removed and discarded, if necessary a new visqueen sheet 44 laid down and the collection process repeated.

After noticeable periods of long usage, there is no evidence of roof destruction from the use of the present system. It can therefore be seen that the system accomplishes all of its stated objectives.

What is claimed is:

1. A grease absorption box for use with roof top cooking exhaust systems, comprising:

(a) a plurality of durable, lightweight, non-biodegradable blocks, each of said blocks having means to be releasably joined to another of said blocks so as to allow formation of a perimeter curb around a roof top cooking exhaust fan, and with at least some of said blocks having means to allow water to drain from within said perimeter curb to outside of said perimeter curb;

(b) a bottom bed of highly porous filler material within said perimeter curb;

(c) a layer of water permeable flexible sheet material covering said porous filler material; and (d) on top of said sheet and substantial filling the rest of said perimeter curb a finely divided grease absorption material.

2. The grease absorption box of claim 1 wherein said bottom bed is pea grooved.

3. The grease absorption box of claim 1 wherein said flexible sheet is perforated visqueen.

4. The grease absorption box of claim 1 wherein said finely divided grease absorber is silica sand.

5. The grease absorption box of claim 1 wherein said means for releasably joining of one block to another is a tongue and groove system.

6. The grease absorption box of claim 1 wherein said blocks are made of a moldable polymeric resinous material.

7. The grease absorption box of claim 6 wherein said blocks are made of reinforced fiberglass.

8. The grease absorption box of claim 6 wherein said blocks are made from a moldable polymeric resinous material selected from the group consisting of polyvinyl chloride, polyethylene, polypropylene, and styrene.

9. The grease absorption box of claim 6 wherein said blocks are comprised of a shell of said material which defines a hollow interior.

10. The grease absorption box of claim 6 wherein each of said blocks has a flattened perimeter edge for resting in a free standing position on a flat surface.

11. A method of controlling grease from collecting on the roofs of restaurants and the like comprising:

(a) building a perimeter curb system around an exhaust fan from a plurality of lightweight durable, non-biodegradable blocks, with at least some of said blocks having means to allow water to drain from within said perimeter curb to outside of said perimeter curb;

(b) filling said perimeter curb with a bottom layer of porous filler material which easily allows water to drain therethrough; and (c) placing over said bottom layer, a layer of removable grease absorption medium.

* * * * *